US006651557B1

(12) United States Patent
Costin et al.

(10) Patent No.: US 6,651,557 B1
(45) Date of Patent: Nov. 25, 2003

(54) PRINTING UNIT

(76) Inventors: Ian John Costin, 324 Brahms Ct., Wheaton, IL (US) 60187; John Clark Jackson, 24 Willow Park Lane, Longridge, Preston, Lancashire (GB), PR3 3HJ ( * ) Notice: Subject to any disclaimer, the term of this patent is extended or adjusted under 35 U.S.C. 154(b) by 0 days.

(21) Appl. No.: 09/509,954

(22) PCT Filed: Sep. 30, 1998

(86) PCT No.: PCT/GB98/02931

§ 371 (c)(1),
(2), (4) Date: Nov. 13, 2000

(87) PCT Pub. No.: WO99/16622

PCT Pub. Date: Apr. 8, 1999

(Under 37 CFR 1.47)

(30) Foreign Application Priority Data

Oct. 1, 1997 (GB) ..... 97020885

(51) Int. Cl.[7] ..... B41F 7/02
(52) U.S. Cl. ..... 101/218; 101/220; 101/247
(58) Field of Search ..... 101/216, 218, 101/247, 217, 219, 220, 229

(56) References Cited

U.S. PATENT DOCUMENTS 4,369,705 A 1/1983 Gelinas
5,134,934 A 8/1992 Knauer et al.
5,161,463 A 11/1992 Knauer et al.

FOREIGN PATENT DOCUMENTS

| | | |
|---|---|---|
| DE | 8410619 U | 6/1985 |
| DE | 19603663 A1 | 8/1997 |
| GB | 872849 | 7/1961 |
| GB | 2025326 A | 1/1980 |
| GB | 2281537 A | 3/1995 |
| GB | 2309668 A | 8/1997 |

*Primary Examiner*—Ren Yan
(74) *Attorney, Agent, or Firm*—Marshall, Gerstein & Borun LLP

(57) ABSTRACT

A printing unit comprises a pair of blanket cylinders (2) that form a nip through which a substrate can pass as ink images are transferred from the blanket cylinders to both sides of the substrate. Each blanket cylinder (2) is provided with a pair of plate cylinders (1A, 1B) carrying inked lithographic plates which transfer ink images to their respective blanket cylinder. While one plate cylinder (1A, 1B) is in contact with its blanket cylinder (2) the lithographic plates on the other plate cylinder (1A, 1B) can be changed. The other plate cylinder can then be brought into contact with the blanket cylinder (2) and the first plate cylinder removed from contact to allow its plates to be changed. The plate cylinders on one side of the substrate can be moved independently of those on the other side of the substrate. The blanket cylinders (2) can also be moved to release the substrate. Movement of the plate cylinders (1A, 1B) and the blanket cylinders (2) is achieved by means of eccentric bearing sleeves and linear actuators. The motion of the cylinders is interlocked to avoid interference between them.

21 Claims, 2 Drawing Sheets

PRINTING UNIT

FIELD OF THE INVENTION

This invention relates to a printing unit, in particular for a rotary offset printing press with flying plate change capacity.

BACKGROUND OF THE INVENTION

Rotary offset printing presses, used for example in the printing of newspapers, including colour printing on each side of a substrate such as paper generally comprise a plurality of printing units.

A printing unit prints one colour on each side of a substrate, usually paper. In the offset lithographic printing process for double-sided printing, or perfecting, the printing unit comprises a pair of printing couples. Each couple comprises a plate cylinder and a blanket cylinder. Each plate cylinder carries one or more printing plates around its periphery. Each printing plate has portions which are water sensitive and portions which are not. Ink and a dampening solution, such as water, are applied to the plates on the printing cylinder. The presence of the dampening solution on the water sensitive portions means that the ink only remains on the non-sensitive portions. Each plate cylinder is pressed against its co-acting blanket cylinder which is a cylinder with a resilient surface, usually an elastomeric material. As the cylinders in each couple rotate the ink image formed on the plate cylinder is transferred to the blanket cylinder. The substrate, eg. newsprint, passes between the two blanket cylinders of the printing unit which transfer the ink image onto each side of the substrate.

In the printing industry, in particular the newspaper industry, there is a need to be able to change any page content, particularly on the front and back pages, with the minimum of printing machine down time.

One proposal is disclosed in U.S. Pat. No. 5,134,934 The proposal involves adding an additional plate cylinder to each printing-couple such that each blanket cylinder has two associated plate cylinders. The blanket cylinders have a first and a second printing position such that each blanket cylinder is in contact with a respective first or second plate cylinder and is also in printing contact with the substrate. There is an intermediate off-printing position in which the blanket cylinders are neither in contact with printing cylinders nor the substrate.

In this proposal, the blanket cylinder axes are moved by means of eccentric bearing sleeves where the axes of the bearing sleeves are closer to the substrate path than the blanket cylinder axes, such that the blanket cylinders move in a direction substantially parallel to the substrate path between the first and second printing positions. With the blanket cylinders in the first or second printing position the plate cylinders on either side of the substrate not in contact can be stopped and their plates changed while the press is still operating.

This apparatus has the drawback that each of the two blanket cylinders-on either side of the substrate must be moved together in order to maintain printing geometry. Thus if it is desired to change the plates on one side only, for example for changes to the front or back page as is often the case in the newspaper industry, for the side that is not being changed either a duplicate set of plates must be provided with the obvious wastage and extra labour required to fit the plates or the plates for that side must be swapped between the plate cylinders which is time consuming and greatly reduces the advantages of on the fly plate changes. It is also essential that each blanket cylinder is provided with two plate cylinders whereas it might be desired in some printing units only to change the plates for one blanket cylinder and thus provide a single plate cylinder for the other blanket cylinder. Furthermore, as the blanket cylinders must be moved substantially parallel to the moving substrate and also release and then regrip the substrate while the substrate remains in motion, there is a risk of tearing of the substrate.

DE-U-84 10 619 discloses a printing unit for printing on one side of the substrate wherein a blanket cylinder is associated with two plate cylinders. Each plate cylinder is arranged to be movable in a direction parallel to the path of the substrate to bring the plate cylinder into or out of contact with a fixed blanket cylinder. The disclosure does not address the problems with such a system, in particular how the plate cylinders are arranged for movement whilst ensuring that the plate cylinder will maintain register for further printing, nor how, in particular with printing units arranged on either side of the substrate for printing on each side, the blanket cylinders may be moved apart to release the substrate, as will be required from time to time.

SUMMARY OF THE INVENTION

It is an object of the present invention to alleviate, at least partially, some of the above problems.

Accordingly, the present invention provides a printing unit for double-sided offset printing on a substrate, said unit comprising:

- a pair of blanket cylinders disposed one on either side of a substrate path;
- a first pair of plate cylinders each selectively moveable into and out of contact with a first one of said pair of blanket cylinders;
- wherein at least one of said blanket cylinders is moveable to a first position for pressing said substrate against the other blanket cylinder and is moveable to a second position to provide a clearance between said blanket cylinders along said substrate path.

BRIEF DESCRIPTION OF THE DRAWINGS

Embodiments of the invention will now be described, by way of example only, with reference to the accompanying drawings in which.

DETAILED DESCRIPTION OF THE PREFERRED EMBODIMENTS

Figure 1:
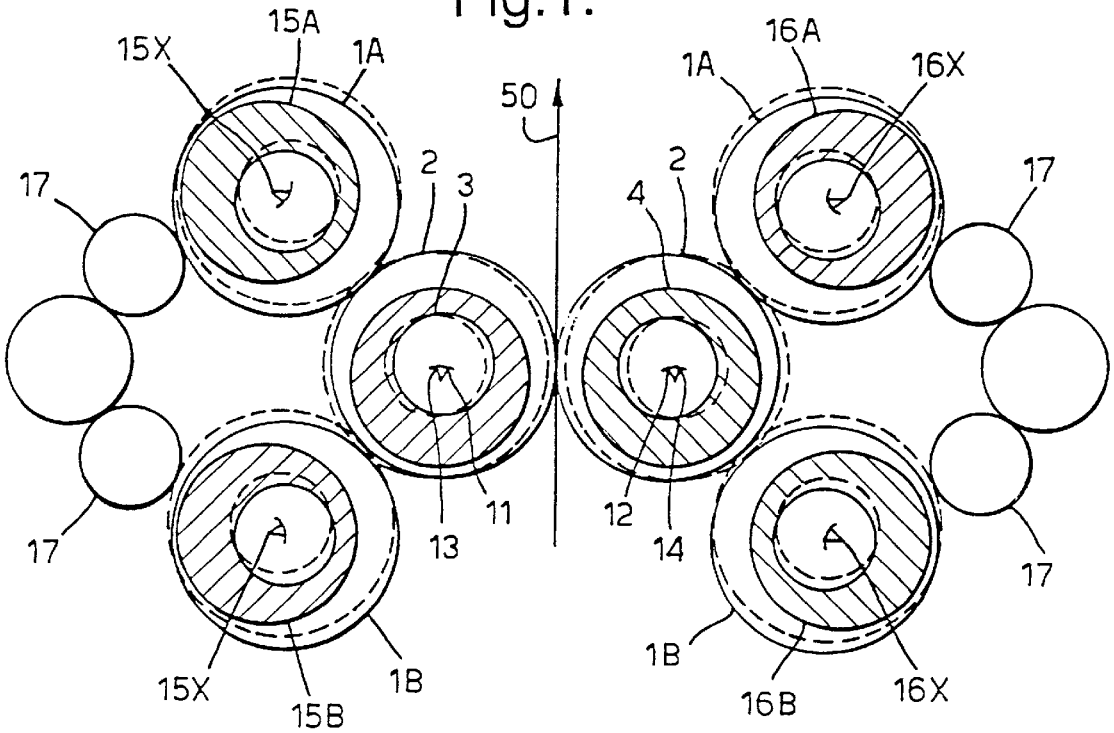
FIG. 1 illustrates the printing cylinder configuration of a printing unit according to the invention.

An embodiment of the present invention is shown in FIG. 1. The printing unit comprises a pair of blanket cylinders 2 arranged either side of a substrate path 50. Each blanket cylinder 2 is associated with a pair of plate cylinders 1A, 1B. In FIG. 1 each plate cylinder 1A, 1B is mounted by means of respective eccentric bearing sleeves 15A, 15B, 16A, 16B. In the condition shown by the solid outlines of the cylinders, the upper plate cylinders 1A are in contact with respective blanket cylinders 2 and the lower plate cylinders 1B are not in contact with the blanket cylinders 2. In this state, the lower plate cylinders 1B can be stationary whilst the upper plate cylinders 1A and blanket cylinders 2 are rotating and printing on a substrate. The lithographic plates on the lower plate cylinders 1B can be removed and replaced.

The invention could also be used on a printing unit where the plate cylinders are replaced by cylinders which carry the printing image by means other than the illustrated plates, for example where the cylinders carry the printing image by laser imaging, irradiation, or magnetic means.

When it is desired to swap from printing with the plates on an upper plate cylinder 1A to those on a lower plate cylinder 1B the respective bearing sleeves are rotated about their axes 16X. This moves the plate cylinders 1A, 1B to the positions shown by the dashed outlines. The lower plate cylinder 1B is then in contact with and counter-rotating with respect to its blanket cylinder 2, and the upper plate cylinder 1A is not in contact with the blanket cylinder 2 and can be stopped for plate changing.

The above described on the fly plate changing operation can be performed, if desired, without moving the blanket cylinders 2. It is possible to move the plate cylinders 1A, 1B on one side of the substrate without moving those on the other side. Thus it is possible to provide independent plate cylinder selection such that asymmetrical printing configurations are possible, for example printing using the upper plate cylinder 1A on one side of the substrate and the lower plate cylinder 1B on the other side of the substrate. The plates on one side of the substrate can be changed without the need either to swap the plates on the other side or provide duplicate plates on the other side. This avoids the need for extra plates and the time to change them. Indeed a pair of plate cylinders 1A, 1B could be provided on only one side of the substrate with the other side having a conventional blanket cylinder and single plate cylinder couple.

According to the embodiment of the invention shown in FIG. 1, the blanket cylinders 2 can also still separate at machine standstill. This is also achieved by eccentric bearing sleeves 4. The axes of the blanket cylinders 2 and bearing sleeves 4 are arranged so that the blanket cylinders 2 move substantially normally to the plane of the substrate at the point of contact. The motion of the plate cylinders 1A, 1B creates the space that allows the blanket cylinders 2 to move apart. The blanket cylinders 2 shown by solid lines in FIG. 3 have their axes at points 11 and 12 such that there is a blanket mate point where the substrate is squeezed between them with a necessary printing impression force. Rotating the bearing sleeves 4 displaces the blanket cylinders axes to points 13 and 14. The periphery of the blanket cylinders 2 in this off-printing state are shown by dashed lines. There is a clearance between the blanket cylinders 2. This allows the substrate to be released, for example in the event of a tear, and allows new substrate to be threaded between the blanket cylinders 2. The clearance between the blanket cylinders 2 need only be very small, for example 1.5 mm. To enable this to take place the plate cylinders 1A, 1B are moved so that none of the blanket and plate cylinders is touching any of the other cylinders. The radii of the eccentric bearing sleeves are minimised consistent with a reasonable non-contact gap between the blanket cylinders 2 in order to maximize the mechanical advantage of the rotating mechanism for the bearing sleeves and hence their resistance to the printing impression reaction force.

Each blanket cylinder 2 can have a single ink train for supplying ink and dampening solution via one or other plate cylinder 1A, 1B and an ink application roller 17 provided for each plate cylinder. The dampening solution may be applied to the plate cylinders separately from the ink, or as a single fluid. Further rollers and scrapers may be provided to remove excess ink from each ink train and to recirculate the removed ink via the ink train.

The geometry of the plate cylinder bearing sleeves 15, 16 in the embodiment of the invention illustrated in FIG. 1 is arranged so that the movements of the plate cylinder axes are substantially parallel to the line of the substrate. This facilitates the disconnection of each plate cylinder 1A, 1B from its blanket cylinder and ink application roller 17 in one movement. The axis of rotation of each plate cylinder bearing sleeve 15X, 16X is positioned close to the line of centres between the axis of its respective plate cylinder and the corresponding blanket cylinder axis position 11, 12 such that when the cylinders are in operational contact, the printing impression reaction is not transmitted to the plate cylinder bearing sleeve rotation mechanism.

Figure 2:
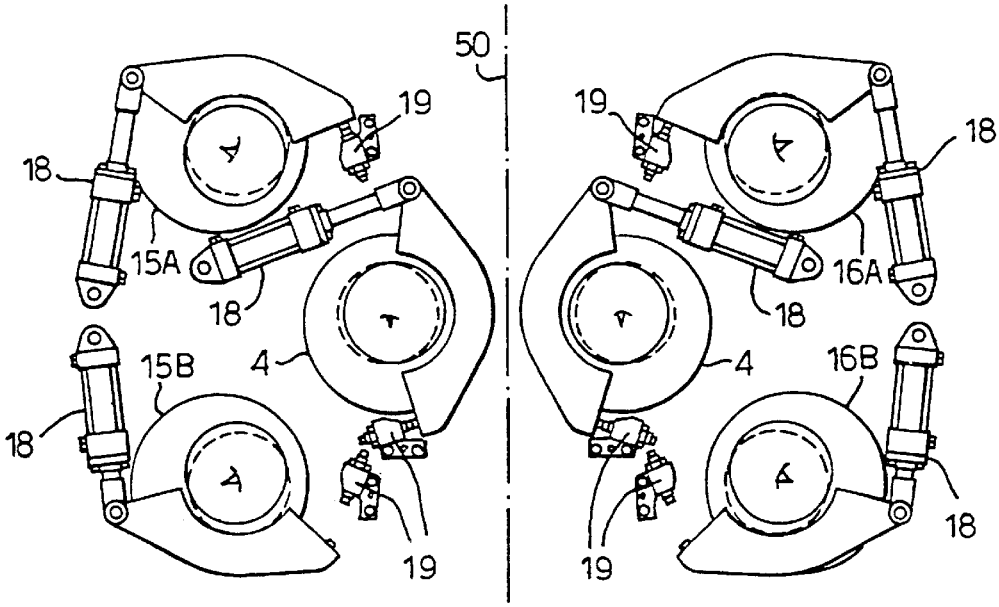
FIG. 2 illustrates an embodiment of a mechanism for moving the cylinders of the printing unit of FIG. 1.

FIG. 2 illustrates a first embodiment of a bearing sleeve rotation mechanism for the printing unit of FIG. 1. Each bearing sleeve 15, 16 is provided with an individual linear actuator 18. One end of each actuator is pivotally connected to a fixed point on the printing unit frame and the other end of the actuator is pivotally connected to a member attached to the eccentric sleeve. The actuators 18 can be of any suitable construction, for example hydraulic or electrical. The operation of the actuators 18 can be interlocked and programmed to provide predetermined kinematics that ensure non-interference of the various cylinders, for example to move the plate cylinders 1 out of the way before the blanket cylinders 2 commence their movement.

Adjustable stops 19 are provided against which each eccentric sleeve assembly 4, 15, 16 can be held by its respective actuator 18. Adjustment of the stops 19 allows the cylinder geometry to be set, for example to control the centre to centre distance of the blanket cylinders 2 with respect to each other and with respect to the plate cylinders 1A, 1B.

Figure 3:
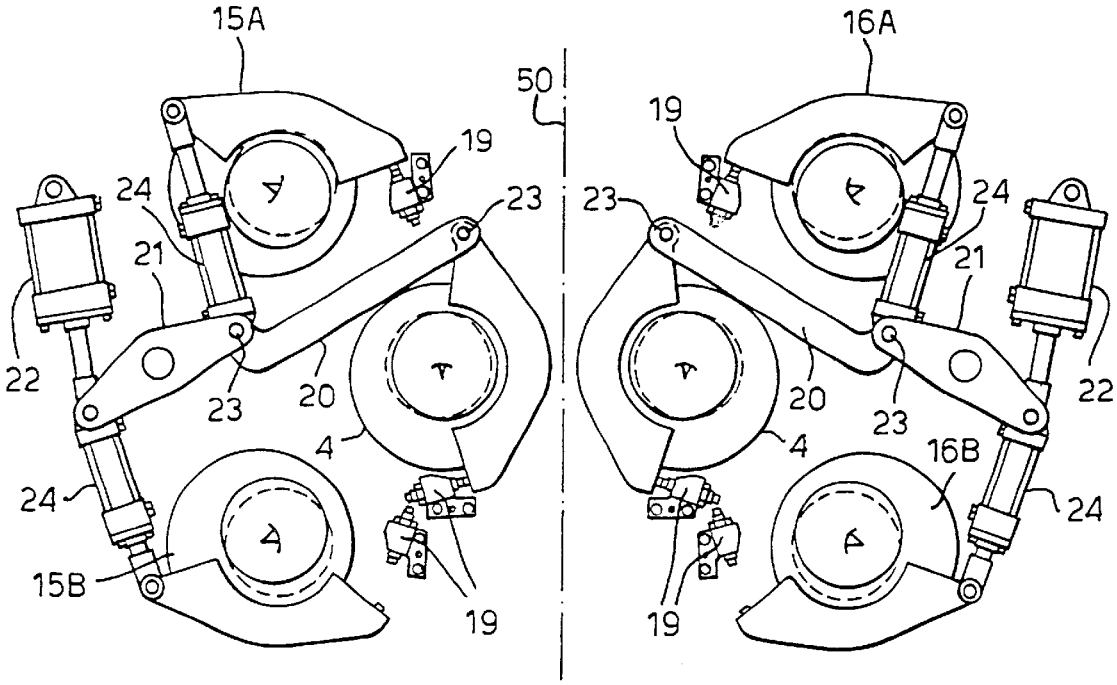
FIG. 3 illustrates a second embodiment of a mechanism for moving the printing cylinders of the printing unit of FIG. 1.

An alternative bearing sleeve rotation mechanism is illustrated in FIG. 3 in which a mechanical interconnecting mechanism ensures non-interference between the cylinders. As shown in FIG. 3, the blanket cylinder eccentric bearing sleeve 4 is connected by a connecting rod 20 to a bell-crank lever 21 which is in turn attached to an actuator 22. When the blanket cylinder bearing sleeve 4 is positioned such that the blanket cylinder axis is in the on-printing position 11, 12 in FIG. 3, the bell-crank 21 pivot and the connecting rod gudgeon pins 23 are substantially aligned in order to form a toggle lock and to protect the actuator 22 from the blanket cylinder contact reaction load. The bearing sleeves 15A, 15B, 16A, 16B of the plate cylinders are connected to the same bell-crank 21 as their blanket cylinder bearing sleeve 4, so that the bell-crank actuator 22 induces simultaneous relative motion in all three bearing sleeves. The geometry of the bell-crank 21 and connecting rod 20 mechanism ensures that when moving the blanket cylinder to the off-printing position, the plate cylinder axes commence motion before the blanket cylinder axis and vice versa when moving the blanket cylinder to the on-printing position, thereby providing motion with no interference.

The connecting members between the bell-crank 21 and the plate cylinder bearing sleeves 15, 16 are linear actuators 24. They can be activated independently of the bell-crank actuator 22 to change from one plate cylinder to the other without disturbing the blanket cylinder contact with the substrate.

Figure 4:
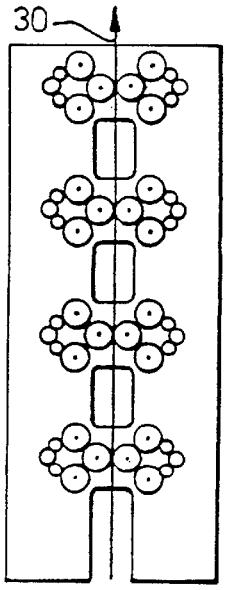
FIG. 4 illustrates schematically a first printing apparatus according to the invention.

Full colour offset lithographic printing involves decomposing the colour image into "separations" to facilitate the successive printing of the three secondary colours; cyan, magenta and yellow, and also black. In order to achieve the full colour image on the substrate, four printing units, each printing one of the separations, are arranged in successive progression such that the substrate can pass through each contact nip of the pairs of blanket cylinders. FIG. 4 shows four printing units according to the invention stacked vertically with a vertical substrate path 30, and FIG. 5 shows a horizontal configuration of four printing units and horizontal substrate path 31.

Figure 5:
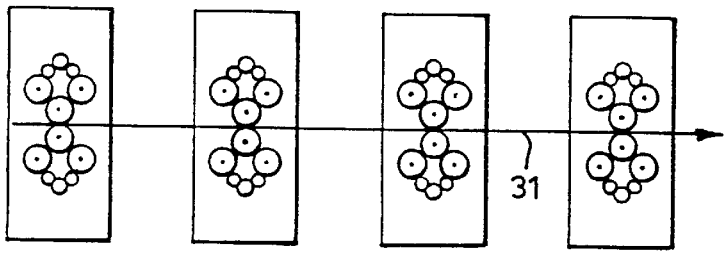
FIG. 5 illustrates a second printing apparatus according to the invention.

Although each of the printing units in the apparatus of FIGS. 4 and 5 has a pair of plate cylinders on both sides of the substrate, some newspaper printers will need the facility for on the fly plate changing on, for example, the front page only, in which case a pair of interchangeable plate cylinders would only be provided in each printing unit on one side of the substrate. It is also possible that only one of the plate changing units, e.g. the one for printing the black portions, has the plate changing facility on one or both sides, but the remaining three printing units, e.g. for colour images, have a conventional plate cylinder arrangement.

A number of different drive options are available for rotating the cylinders of the printing apparatus. These include:

(1) Couple shaftless drive systems where a servo motor is provided for each printing cylinder. This offers the maximum versatility and electronic control.

(2) Distributed shaftless drive systems in which one motor is provided per printing unit and a connecting shaft couples the four printing units in the apparatus of FIG. 4 or FIG. 5. This has the advantage that should one of the motors fail, the press can still continue, although at reduced speed, because drive to the unit with the failed motor is provided via the connecting shaft. However, this is offset against the space taken up by the connecting shaft and the gears which it is necessary to provide.

(3) Conventional shaft drive which comprises typically one motor per stack of four printing units joined by a connecting shaft, and several stacks sharing a common drive shaft. This is an inexpensive solution, but is not particularly flexible and accessibility to the printing units can be restricted because of the drive shaft and associated clutches.

Each of these drive options can be adapted for use with the present invention by the provision of suitable gearing and clutch mechanisms to allow the non-printing plate cylinder to be brought up to printing speed in proper registration before being brought into contact with the blanket cylinder for on the fly page changing. The preferred option is a servo motor for each printing cylinder.

What is claimed is:

1. A printing unit for double-sided offset printing on a substrate, said unit comprising:

a first blanket cylinder disposed on a first side of a substrate path;

a second blanket cylinder disposed on a second side of a substrate path;

a first pair of plate cylinders each selectively moveable into and out of contact with the first blanket cylinder;

a second pair of plate cylinders each selectively moveable into and out of contact with the second blanket cylinder;

wherein at least one of said blanket cylinders is moveable to a first position for pressing said substrate against the other blanket cylinder and is moveable to a second position to provide a clearance between said blanket cylinders along said substrate paths; and wherein the first blanket cylinder and the second blanket cylinder are capable of continuously printing on both sides of the substrate while one of the first pair of plate cylinders is not in contact with the first blanket cylinder and one of the second pair of plate cylinders is not in contact with the second blanket cylinder.

2. A printing unit according to claim 1 wherein at least one of said cylinders is mounted via at least one bearing sleeve eccentric for providing transverse movement of the cylinder axis.

3. A printing unit according to claim 2, wherein the axis of at least one of said blanket cylinders and the axis of its at least one bearing sleeve are substantially parallel and spaced apart in the direction of the substrate path.

4. A printing unit according to claim 2, wherein the axis of at least one of said plate cylinders and the axis of its at least one bearing sleeve are substantially parallel and spaced apart such that when said at least one plate cylinder is in contact with its blanket cylinder, the respective axes of said plate cylinder, bearing sleeve and blanket cylinder lie substantially in a plane.

5. A printing unit according to claim 1, wherein at least one of said cylinders is provided with an actuator for moving the cylinder axis.

6. A printing unit according to claim 5, wherein said actuator is hydraulic.

7. A printing unit according to claim 5, wherein said actuator is electrical.

8. A printing unit according to claim 5, wherein said actuator is linear.

9. A printing unit according to claim 1, wherein a first common ink train is provided for said first pair of plate cylinders.

10. A printing unit according to claim 9, wherein a second common ink train is provided for said second pair of plate cylinders.

11. A printing unit according to claim 9, further comprising an ink application roller for each plate cylinder.

12. A printing unit according to claim 11, wherein when a plate cylinder is moved out of contact with its blanket cylinder it is also out of contact with its ink application roller.

13. A printing unit according to claim 1, wherein ink and dampening solution are applied to at least one of the plate cylinders as a single fluid.

14. A printing unit for double-sided offset printing on a substrate, said unit comprising:

a pair of blanket cylinders disposed one on either side of a substrate path;

a first pair of plate cylinders each selectively moveable into and out of contact with a first one of said pair of blanket cylinders;

wherein at least one of said blanket cylinders is moveable to a first position for pressing said substrate against the other blanket cylinder and is moveable to a second position to provide a clearance between said blanket cylinders along said substrate path, and wherein an interlock mechanism is provided to prevent interference between the motion of a movable blanket cylinder and its associated pair of plate cylinders.

15. A printing unit according to claim 14, wherein said interlock mechanism is electronic.

16. A printing unit according to claim 14, wherein said interlock mechanism comprises a bell-crank.

17. A printing unit according to claim 16, wherein said interlock mechanism further comprises a bell-crank actuator and connecting rod to produce simultaneous relative motion of said at least one blanket cylinder and said pair of plate cylinders.

18. A printing unit according to claim 17, wherein, when said blanket cylinder is in said first position, the pivot of said bell-crank and the gudgeon pins of said connecting rod are substantially aligned to form a toggle lock and to protect the bell-crank actuator from the reaction force load on the blanket cylinder.

19. A printing unit according to claim 17, wherein, when moving said blanket cylinder from said first position, said interlock mechanism ensures said plate cylinders commence motion before said blanket cylinder.

20. A printing unit according to claim 16, further comprising actuators between said bell-crank and said pair of plate cylinders for moving one of said pair of plate cylinders into and one of said pair of plate cylinders out of contact respectively with said blanket cylinder, without moving said blanket cylinder.

21. A printing unit for double-sided offset printing on a substrate, said unit comprising:

a first blanket cylinder disposed on a first side of a substrate path;

a second blanket cylinder disposed on a second side of a substrate path;

a first pair of plate cylinders each selectively moveable into and out of contact with the first blanket cylinder;

a second pair of plate cylinders each selectively moveable into and out of contact with the second blanket cylinder;

wherein at least one of said blanket cylinders is moveable to a first position for pressing said substrate against the other blanket cylinder and is moveable to a second position to provide a clearance between said blanket cylinders along said substrate path; and wherein an interlock mechanism is provided to prevent interference between the motion of a movable blanket cylinder and its associated pair of plate cylinders, the interlock mechanism comprising a connecting rod that produces simultaneous relative motion of said at least one blanket cylinder and said pair of plate cylinders.

* * * * *

UNITED STATES PATENT AND TRADEMARK OFFICE

CERTIFICATE OF CORRECTION

PATENT NO. : 6,651,557 B1
DATED : November 25, 2003
INVENTOR(S) : Ian J. Costin et al.

It is certified that error appears in the above-identified patent and that said Letters Patent is hereby corrected as shown below:

Title page,
Item [76], Inventors, please delete "Lancashire (GB), PR3 3HJ" and insert -- Lancashire PR3 3HJ, (GB) --.

Column 1,
Line 39, please delete "5,134,934 The" and insert -- 5,134,934. The --.
Line 41, please delete "printing-couple" and insert -- printing couple --.
Line 60, please delete "cylinders-on" and insert -- cylinders on --.

Signed and Sealed this

Eighth Day of June, 2004

JON W. DUDAS
*Acting Director of the United States Patent and Trademark Office*